US011739604B2

(12) United States Patent
Almusa et al.

(10) Patent No.: US 11,739,604 B2
(45) Date of Patent: Aug. 29, 2023

(54) EXPANDABLE OVERSHOT-SPEAR TOOL

(71) Applicant: Saudi Arabian Oil Company, Dhahran (SA)

(72) Inventors: Abdulaziz Almusa, Dhahran (SA); Bodong Li, Dhahran (SA); Abdulwahab S. Al-Johar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 69 days.

(21) Appl. No.: 17/644,744

(22) Filed: Dec. 16, 2021

(65) Prior Publication Data

US 2023/0193716 A1 Jun. 22, 2023

(51) Int. Cl.

| | |
|---|---|
| ***E21B 31/12*** | (2006.01) |
| ***E21B 31/20*** | (2006.01) |
| ***E21B 31/18*** | (2006.01) |

(52) U.S. Cl.

CPC ..... *E21B 31/20* (2013.01); *E21B 31/18* (2013.01)

(58) Field of Classification Search

CPC ..... E21B 31/20; E21B 31/18

See application file for complete search history.

(56) References Cited

U.S. PATENT DOCUMENTS

| | | | | |
|---|---|---|---|---|
| 1,405,025 | A * | 1/1922 | Sorensen | E21B 31/12 294/102.1 |
| 1,645,010 | A * | 10/1927 | Kinley | E21B 31/20 166/301 |
| 2,487,456 | A | 11/1949 | Lowrey | |
| 3,574,385 | A | 4/1971 | Pignatation, Jr. | |
| 3,727,967 | A * | 4/1973 | Anastasiu | E21B 31/18 294/102.1 |
| 5,242,201 | A | 9/1993 | Beeman | |
| 5,361,844 | A | 11/1994 | Taylor et al. | |
| 5,580,114 | A | 12/1996 | Palmer | |
| 6,095,583 | A | 8/2000 | Beeman | |
| 6,425,615 | B1 | 7/2002 | Mullane, Jr. | |
| 6,926,082 | B2 | 8/2005 | Wills et al. | |
| 7,775,572 | B2 * | 8/2010 | Slack | E21B 19/06 294/86.15 |

(Continued)

FOREIGN PATENT DOCUMENTS

| | | |
|---|---|---|
| CN | 204252904 U | 4/2015 |
| CN | 204327024 U | 5/2015 |

OTHER PUBLICATIONS

Saigao Group; Working Principle of Downhole Fishing Tools; https://www.saigaogroup.com/news/working-principle-of-downhole-fishing-tool.html; Aug. 22, 2021.

*Primary Examiner* — Taras P Bemko

(74) *Attorney, Agent, or Firm* — Leason Ellis LLP

(57) ABSTRACT

A convertible fishing tool is provided for removing an object (fish) from a wellbore. The fishing tool includes an elongated hollow main housing and a plurality of slip blades that are disposed distal to the main housing and move radially between fully retracted positions and fully extended positions. In the fully retracted positions, the fishing tool is in spear configuration and in the fully extended positions, the fishing tool is in an overshot configuration. The fishing tool also includes an actuation system configured to move the plurality of slip blades in a radial direction between the fully retracted positions and the fully extended positions.

25 Claims, 8 Drawing Sheets

(56) References Cited

U.S. PATENT DOCUMENTS

| | | | | |
|---|---|---|---|---|
| 8,955,590 | B2 | 2/2015 | Salvador | |
| 9,022,440 | B2 | 5/2015 | Guidry et al. | |
| 10,036,211 | B2 | 7/2018 | Sullivan et al. | |
| 10,260,303 | B2 | 4/2019 | Manera et al. | |
| 2004/0123986 | A1* | 7/2004 | Hailey | E21B 31/20 166/301 |
| 2009/0134203 | A1* | 5/2009 | Domec | B23K 37/0531 228/2.1 |
| 2009/0272543 | A1* | 11/2009 | Bouligny | E21B 19/16 414/800 |
| 2014/0069649 | A1* | 3/2014 | Streater, Jr. | E21B 31/18 166/301 |
| 2014/0138969 | A1* | 5/2014 | Guidry | E21B 31/18 294/86.13 |
| 2019/0301258 | A1 | 10/2019 | Li | |
| 2022/0056777 | A1* | 2/2022 | AlShehri | E21B 31/12 |

* cited by examiner

EXPANDABLE OVERSHOT-SPEAR TOOL

TECHNICAL FIELD

The present disclosure generally relates to fishing tools for removing objects from a wellbore and more particularly, to a fishing tool that combines the two most common fishing tools (spear and overshot) into one single tool.

BACKGROUND

In the chilling, completion, and operation of a hydrocarbon well, various wellbore components are inserted and removed from a wellbore on a lower end of a tubular string. Wellbore components include, but are not limited to, packers, motors, pumps, sensors, sliding sleeves, hydraulically set liners, whipstocks, valves, cement shoe assemblies, drill bits, etc. Unfortunately, as these wellbore components are delivered and removed from the wellbore, the wellbore components themselves or the tubular string they are attached to can become stuck in the wellbore or disconnected from its conveyance. The problem can be exacerbated by complex wellbore geometries or previously existing obstructions in the wellbore.

The lodged tool can be referred to as a fish, and a fishing operation may be performed in an attempt to retrieve the fish. For example, a fishing tool may be deployed downhole from a surface rig or platform. The fishing tool typically comprises a latching or attachment end intended to engage the fish to be retrieved. If the fish cannot be dislodged from the wellbore, the fishing tool is removed from the well. Another downhole tool can then be deployed to separate the fish from its conveyance, such that the conveyance can be retrieved to surface.

One type of fishing tool is a spear type fishing tool that is configured to internally engage the fish and another type of fishing tool is an overshot type fishing tool that is configured to externally engage the fish. Overshot tools are used to engage the fish externally by gripping on its outer structure, while spears offer a method of internal engagement. These two tools are the most commonly used tools in fishing operations due to their simplicity and effectiveness. However, one disadvantage of this arrangement is that each overshot or spear is designed to engage to a specific sized structure. It is common that the fish structure is modified from its original condition and is unknown because of the different factors that initially caused to be lost in hole. For example, twist offs (torsional mechanical failure) of downhole tools while drilling tend to damage the structure at the failure point. Hence, this adds a layer of complication to the fishing operations and educated assumptions methods are required to select the proper size of overshot, spear or any other tool.

Since there are different types of tools, the process can be somewhat of a trial-and-error approach to find the correct fishing tool and to then subsequently, engage and retrieve the fish. Thus, in many situations, the downhole state of the fish is not known and educated assumptions are made to select the proper fishing tool assembly.

SUMMARY

The present disclosure sets forth a convertible fishing tool for removing an object (fish) from a wellbore. The fishing tool includes an elongated hollow main housing and a plurality of slip blades that are disposed distal to the main housing and move radially between fully retracted positions and fully extended positions. In the fully retracted positions, the fishing tool is in spear configuration and in the fully extended positions, the fishing tool is in an overshot configuration. The fishing tool also includes an actuation system configured to move the plurality of slip blades in a radial direction between the fully retracted positions and the fully extended positions.

The present fishing tool has two key features. Firstly, it combines the two most common fishing tools (spear and overshot) in one tool. Secondly, it provides a method of expanding the size of the spear/overshot while the tool is in operating downhole. These two features aim to reduce the previously mentioned trial-and-error approach and avoid pulling out of hole to change tool sizes. These pulling out of hole situations (tripping operations) are costly and consume much of the rig time. Therefore, the significance of this tool is in its versatility that allows it to avoid unnecessary and costly tripping operations. Other advantages of the fishing tool are: saves tripping time (pulling out of hole) due to an incorrect sized fishing to tool or engagement mode and allows for versatile change of the fishing tool to achieve a wide range of sizes.

The present fishing tool introduces variable sizing capability that can be manipulated while the tool is in the wellbore using an actuation mechanism. This allows for efficient operation and avoids trial-and-error approaches to find the correct engagement size to the fish which requires a tripping operation (pulling out of hole) that is costly. Furthermore, it provides both an internal and external option to engage the fish which also reduces the trial-and-error method of engagement a fish.

BRIEF DESCRIPTION OF DRAWING FIGURES

DETAILED DESCRIPTION OF CERTAIN EMBODIMENTS

Now turning to FIGS. 1-15C in which a fishing tool 100 to grip a fish within a wellbore is illustrated. The fishing tool 100 has a number of advantageous features compared to conventional fishing tools. First, it combines the two most common fishing tools (spear and overshot) in one single fishing tool 100. Secondly, it provides a method of expanding the size of the spear/overshot while the tool is in operating downhole. These two features aim to reduce the previously mentioned trial-and-error approach and avoid pulling out of hole to change tool sizes. These pulling out of hole situations (tripping operations) are costly and consume much of the rig time. Therefore, the significance of this tool is in its versatility that allows it to avoid unnecessary and costly tripping operations.

Figure 1:
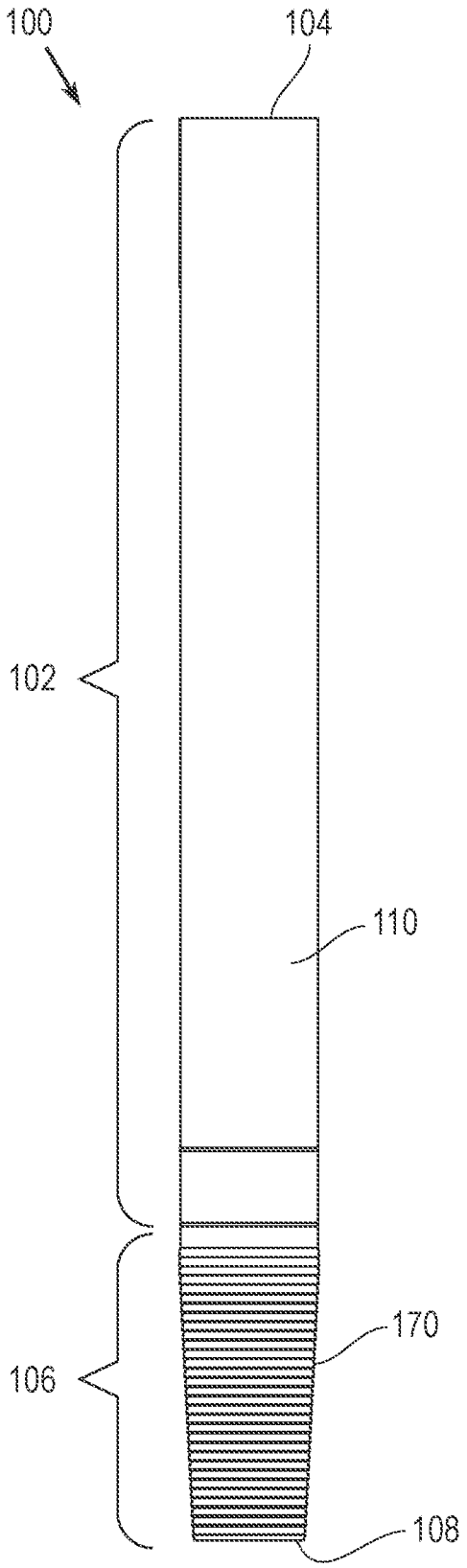
FIG. 1 is a side elevation view of a fishing tool.
Figure 2:
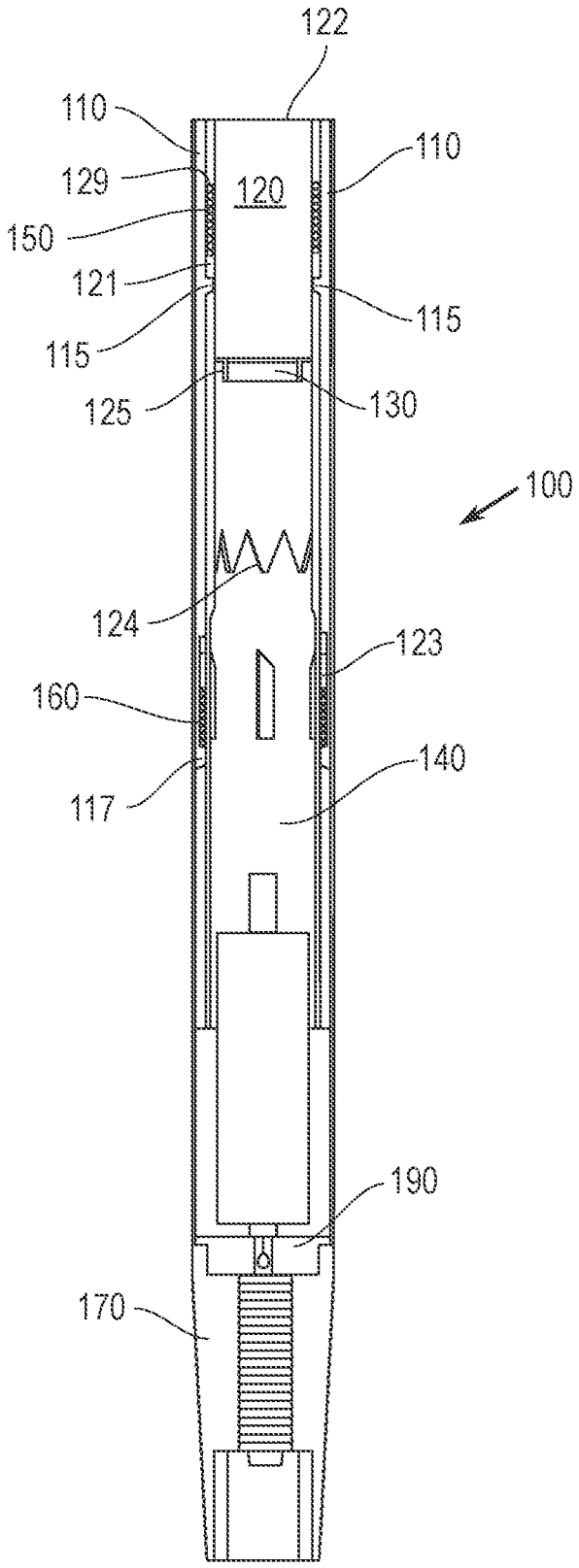
FIG. 2 is side cross-sectional view of the fishing tool.
Figure 3:
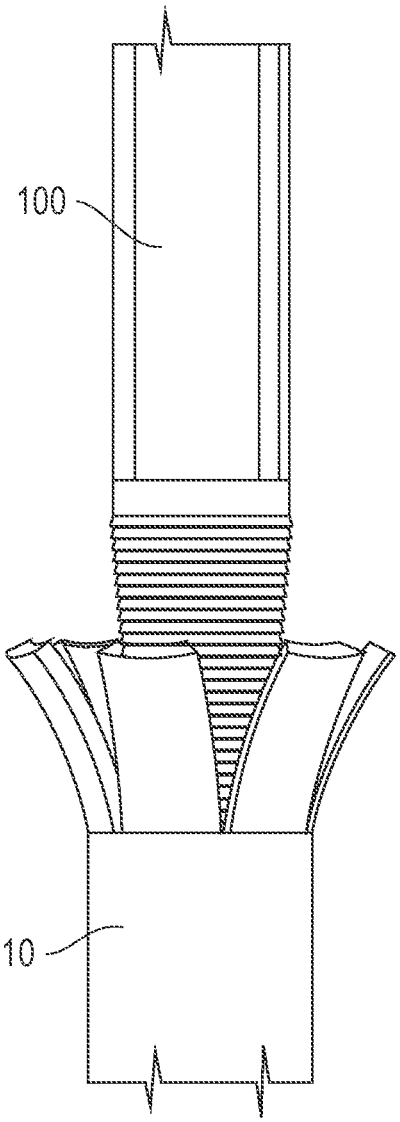
FIG. 3 is a partial side view showing the fishing tool in a spear configuration and in relationship to a fish.

As shown in FIGS. 1-3, the fishing tool 100 is in the form of an expandable overshot-spear tool that is formed of a number of parts that cooperate with one another to allow expansion and retraction of the fishing tool 100. FIG. 1 is a side view of the fishing tool 100 generally showing different sections or regions of the fishing tool and more particularly, the fishing tool 100 can be thought of as including a control system or control section 102 that defines a proximal end 104 of the fishing tool 100 and an active system or active section 106 that defines a distal end 108 of the fishing tool 100. As shown, the control section 102 can have a greater length compared to the active section 106.

Outer Housing 110

FIG. 2 is a cross-sectional view showing the various components of the fishing tool 100. The fishing tool 100 includes an outer housing 110 that is tubular in nature and therefore, the outer housing 110 can be in the form of an outer pipe that is open at both of its ends. A distal end of the outer housing 110 is spaced from the distal end 108 of the assembled fishing tool 100. As shown in FIGS. 1-2, the control section 102 extends the length of the outer housing 110 in that the distal end of the control section 102 comprises the distal end of the outer housing 110. In other words, the outer housing 110 is not present in the active section 106.

Figure 5:
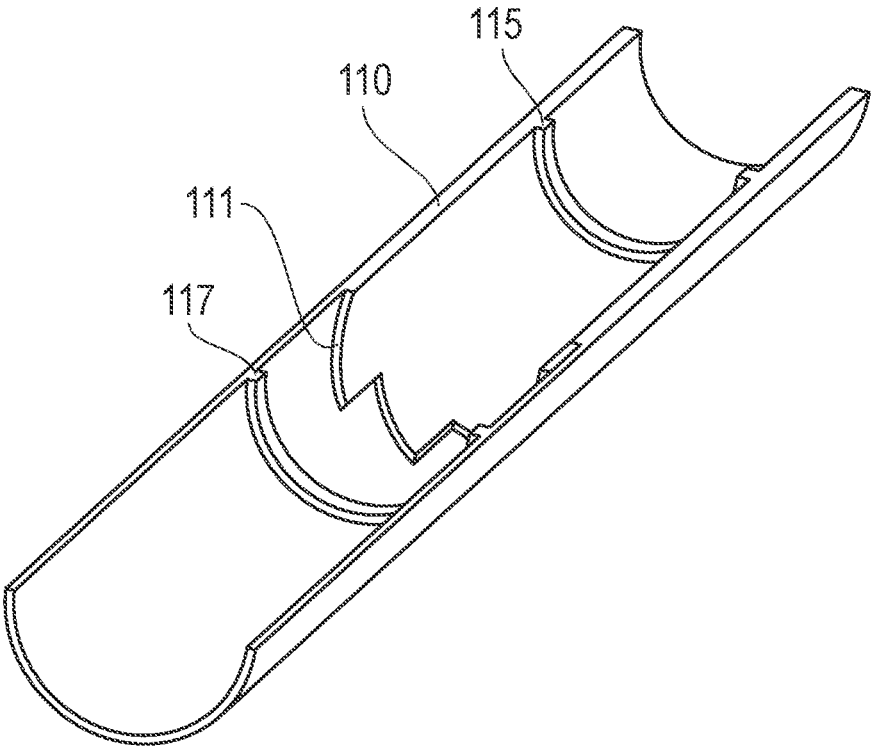
FIG. 5 is a cross-sectional view of a section of an outer housing (pipe) showing an interior thereof.

As shown in FIG. 5, along the inner bore of the outer housing 110 there is a first inner flange (first stop) 115 that protrudes inwardly from the inner surface of the outer housing 110 and can be in the form of a first annular shaped flange that extends around the complete inner circumference of the outer housing 110. In addition, there is a second inner flange (second stop) 117 that protrudes inwardly from the inner surface of the outer housing 110 and can be in the form of a second annular shaped flange that extends around the complete inner circumference of the outer housing 110. The first and second inner flanges 115, 117 are spaced longitudinally apart with the first inner flange 115 being located closer to the proximal end of the outer housing 110, while the second inner flange 117 is located closer to the distal end of the outer housing 110.

In addition, the outer housing 110 includes an inner profile 111 formed along its inner surface. The inner profile 111 is raised relative to the inner surface of the outer housing 110 and as shown in FIG. 5, the inner profile 111 can be a zig-zag pattern that is jagged. The inner profile 111 thus can be thought of as having alternating peaks and valleys. As shown, the inner profile 111 is located between the first and second inner flanges 115, 117 and can be located closer to the second inner flange 117 than the first inner flange 115.

The outer housing 110 can be formed of any number of different materials, including metals, rigid plastics, composites, etc.

Activation Ball Cam 120

Within the hollow interior of the outer housing 110, there is an activation ball cam 120 that is located at the proximal end of the outer housing 110. The activation ball cam 120 has a first (proximal) end 122 and an opposite second (distal) end 124. The first end 122 can be a smooth end, while the second end 124 can have a profile as shown. More specifically, the second end 124 can have a jagged end defined by a plurality of peaks and alternating valleys.

The activation ball cam 120 can thus have a cylindrical tubular shaped structure the same as the outer housing 110. Along the inner bore of the activation ball cam 120, an inwardly directed lip or flange 125 is formed. The flange 125 is thus annular shaped and defines a landing or platform along its top surface.

The proximal end 122 of the activation ball cam 120 has increased thickness relative to the other sections resulting in an outer shoulder 129 being formed along the exterior of the activation ball cam 120. The first inner flange 115 of the outer housing 110 is spaced from and is located distal to the outer shoulder 129 so as to define a first outer area 121 between the activation ball cam 120 and the outer housing 110. There is also a second outer area 123 that is formed along the inner surface of the outer housing 110 and is defined by the second inner flange 117 of the outer housing 110. The second outer area 123 is thus located distal to the first outer area 121. As described herein, the first outer area 121 and the second outer area 123 are configured to and receive biasing members that assist in the axial movement of inner parts of the assembled fishing tool 100. These two areas 121, 123 can have the same or similar or different sizes (dimensions).

As described herein, the activation ball cam 120 moves axially within the outer housing 110 and between the first inner flange 115. Moreover, the activation ball cam 120 can be considered to be a first cam member of the assembled fishing tool 100.

Ball Seat 130

Within the activation ball cam 120 is a ball seat 130. The ball seat 130 is configured to seat against the top surface (platform) of the flange 125. The ball seat 130 has an outwardly protruding lip or flange that seats against the flange 125, while the main body of the ball seat 130 is a cylindrically shaped hollow body that extends below the outwardly protruding flange. The inner diameter of this cylindrically shaped hollow body is thus less than the inner diameter of the activation ball cam 120.

The ball seat 130 can be generally considered to be and to function as a valve seat.

Rotating Blade Cam 140

As shown in FIGS. 2 and 6-8, the fishing tool 100 also includes a rotating blade cam 140 is configured to move both axially and rotationally within the outer housing 110 as described below. The rotating blade cam 140, like other parts, is disposed within the hollow interior of the outer housing 110 and can be in the form of a tubular structure. The rotating blade cam 140 has a complementary shape to the outer housing 110 and therefore can have a cylindrical shape. The rotating blade cam 140 has a first (proximal or top) end 142 and an opposing second (distal or bottom) end 144 and as shown, the rotating blade cam 140 can also be thought to have a first section 141 that extends to the first end 142 and a second section 143 that extends to the second end 144. The rotating blade cam 140 can have a stepped construction in that the second section 143 can have a greater diameter than the first section 141.

The proximal end 142 is configured to be complementary to the profiled second end 124 of the activation ball cam 120. As discussed herein, the profiled second end 124 of the activation ball cam 120 is configured to be received within the hollow inside of the rotating blade cam 140 and can move axially within this hollow inside. The profiled second end 124 engages inner features, as described below, formed within the hollow inside of the rotating blade cam 140 to allow the activation ball cam 120 to drive the rotating blade cam 140 in the axial direction within the outer housing 110.

The rotating blade cam 140 is also designed to ride along the inner profile 111 of outer housing 110 as discussed herein.

As shown in FIGS. 6-9, the first section 141 of the rotating blade cam 140 is a tubular structure that that includes an inner and outer profile that is complementary to the inner profile 111 that is formed along the inner surface of the outer housing 110.

The inner profile of the rotating blade cam 140 is in the form of a plurality of first protrusions (cams) 145 that are formed circumferentially about the outer surface of the rotting blade cam 140. As shown, each protrusion 145 comprises a protrusion that extends longitudinally along the outer surface of the rotating blade cam 140. A top end of the first protrusion 145 comprises an angled edge and thus can be considered to be an angled top end (cam surface). The plurality of first protrusions 145 are oriented parallel to one another. The outer profile of the rotating blade cam 140 is a mirror image of the inner profile in that the outer profile comprises a plurality of second protrusions (cams) 149 that are formed circumferentially about the outer surface of the rotting blade cam 140. As shown, each second protrusion 149 comprises a protrusion that extends longitudinally along the outer surface of the rotating blade cam 140. A top end of the second protrusion 149 comprises an angled edge and thus can be considered to be an angled top end (cam surface). As shown in the cross-sectional view of FIGS. 8-9, the first and second protrusions 145, 149 are thus formed on opposite sides of the tubular shaped wall of the first section 141. The operation of these profiles and interaction with the activation ball cam 120 and the inner profile 111 is described herein.

The rotating blade cam 140 is located in series with the activation ball cam 120 with the rotating blade cam 140 being located distal to the activation ball cam 120.

The function of the plurality of second protrusions 149 formed along the inner surface of the rotating blade cam 140 is provide the activation ball cam 120 with a structure to push on to drive the rotating blade cam 140 downward as described herein. The purpose of the first protrusions 145 is to allow the rotating blade cam 140 to rotate as it moves along the inner profile 111 of the outer housing 110.

Figure 8:
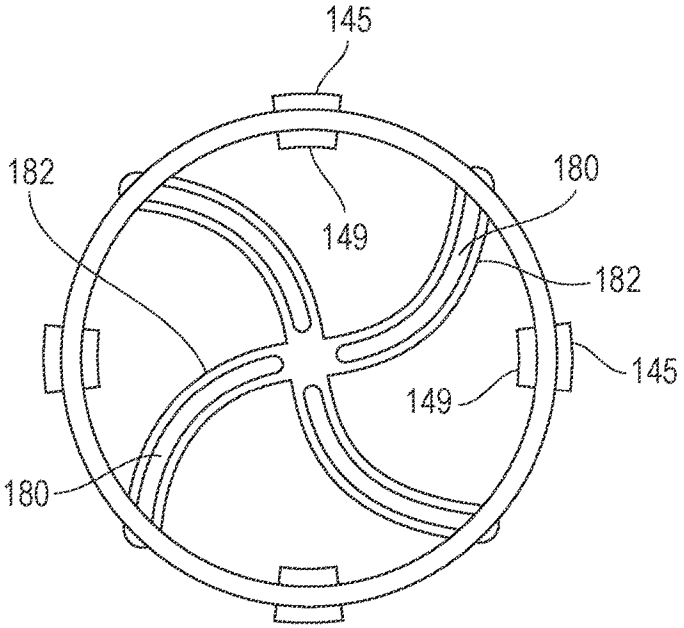
FIG. 8 is a cross-sectional view of the rotating blade cam.
Figure 7:
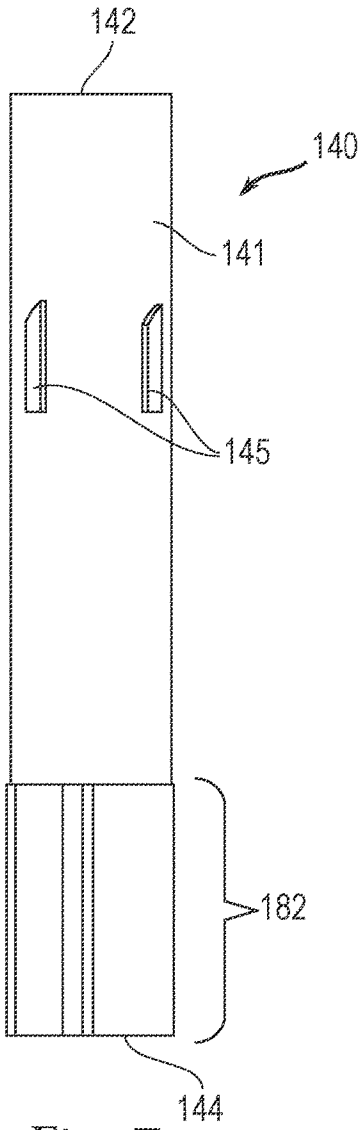
FIG. 7 is a front elevation view thereof.
Figure 6:
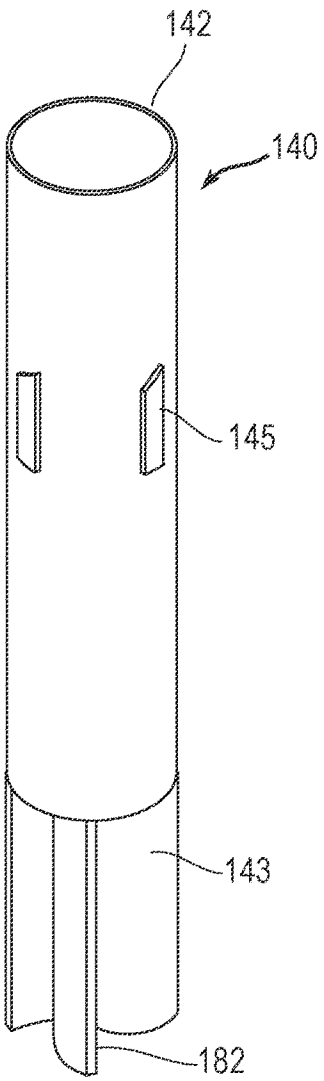
FIG. 6 is a side perspective view of rotating blade cam that is part of an actuation system.
Figure 9:
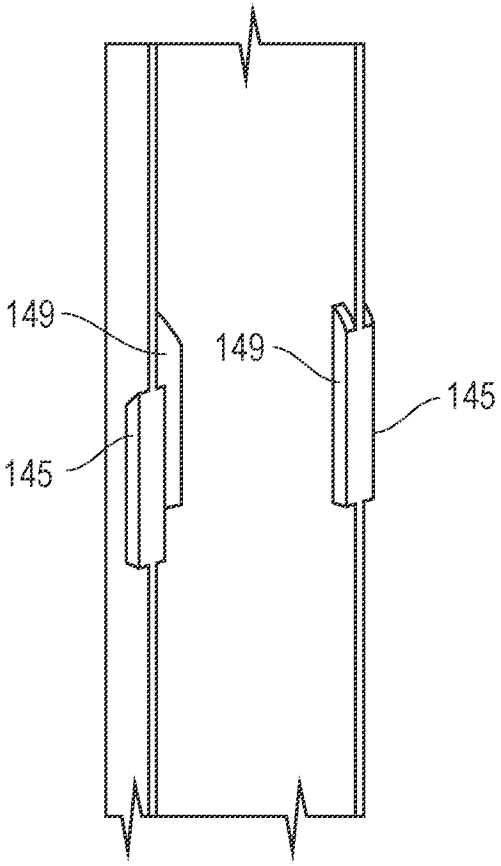
FIG. 9 is another cross-sectional view of the rotating blade cam.

The distal end 144 of the rotating blade cam 140 has a mechanism that is configured to be part of the active section 106 and serves to cause actuation of the active section 106. As shown in FIGS. 6-8, the distal end 144 (second section 143) has a radial slot mechanism (construction) that is defined by a plurality of radial slots 180 that are formed in curved fingers or spokes (blade guides) 182 that extend from a solid center hub 184 to an outer wall of the rotating blade cam 140. In particular, each curved finger 182 include one slot 180 that is itself curved. The curved fingers 182 can total four that can be thought of as defining two pairs of curved fingers 182. Each pair is defined by two curved fingers 182 that are directly opposite one another. The curvatures of these two curved fingers 182 that define the pair are opposite one another in that one of the fingers curves outward in a first direction, while the opposite finger curves outward in an opposite second direction. It will be appreciated that the slots 180 formed within these two opposite curved fingers 182 likewise have curvatures in opposite directions.

Since this radial slot mechanism is part of the rotating blade cam 140, it will be appreciated that the radial slot mechanism rotates and thus the positions of the radial slots 180 relative to the outer housing 110 changes as the rotating blade cam 140 rotates within the outer housing 110.

Active Ball Cam Spring 150

Figures 15A, 15B, 15C:
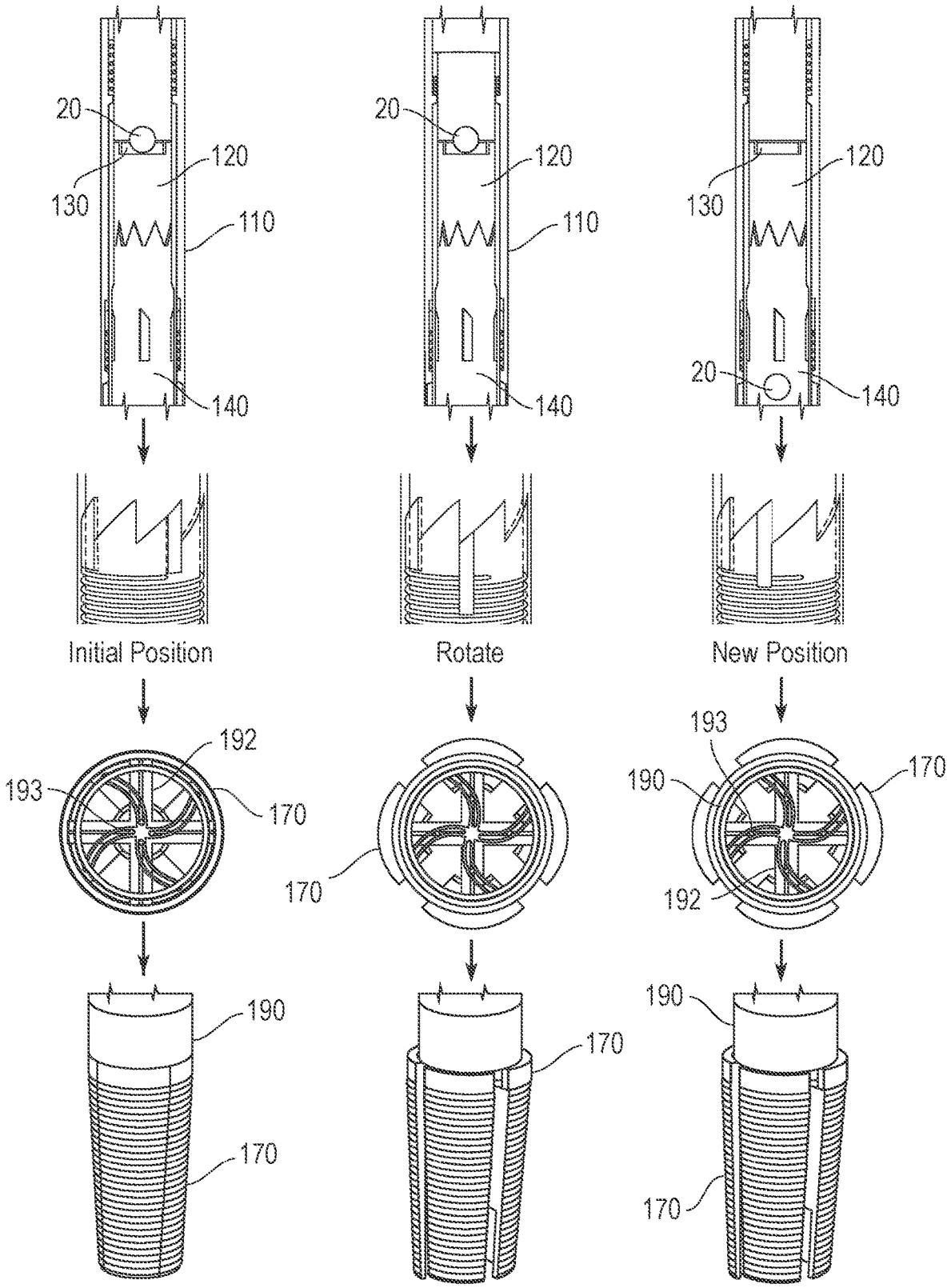
FIGS. 15A-15C show one cycle of the actuation system.

The fishing tool 100 includes a first biasing element in the form of a first spring 150 located within the first outer area 121 and more particularly, the first spring 150 is disposed between the first inner flange 115 and the outer shoulder 129 of the activation ball cam 120. Since the first inner flange 115 is fixed relative to the axially movable activation ball cam 120, the axial movement of the activation ball cam 120 relative to the outer housing 110 acts on the first spring 150. In its at rest, initial state, the first spring 150 is in an extended (non-compressed) state and this results in the activation ball cam 120 being in a raised position relative to the outer housing 110 as shown in FIG. 15A. When the activation ball cam 120 moves downwardly within the outer housing 110 toward the distal end of the fishing tool 100, the first spring 150 compresses and stores energy as shown in FIG. 15B.

The first spring 150 can have an annular shape to allow it fit within the first outer area 121.

Rotating Blade Cam Spring 160

Figure 13:
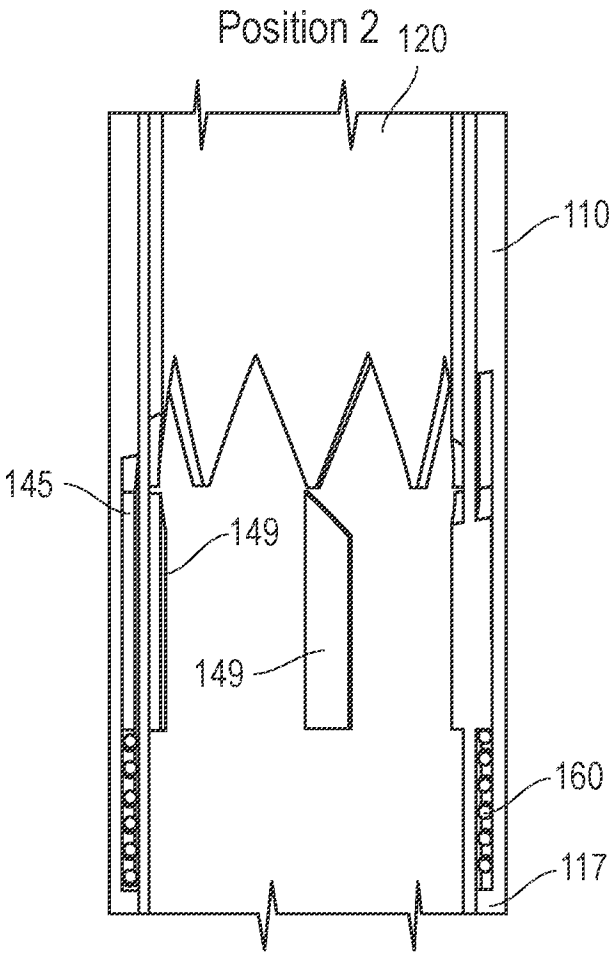
FIG. 13 is a cross-sectional view of the actuation system in a second position.
Figure 12:
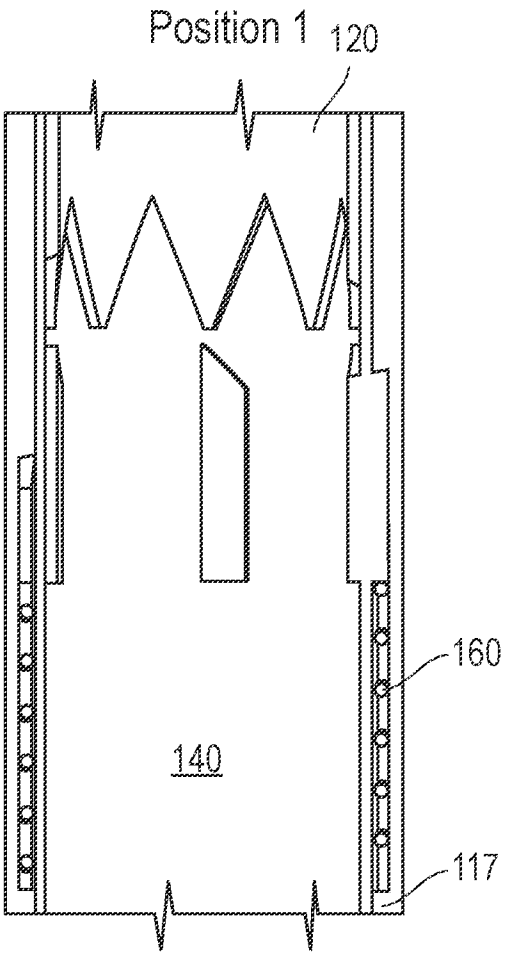
FIG. 12 is a cross-sectional view of the actuation system in a first position.

The fishing tool 100 includes a second biasing element in the form of a second spring 160 located within the second outer area 123 and more particularly, the second spring 160 is disposed between the second inner flange 117 (fixed location) and a bottom edge of one protrusion 145 formed along the outer surface of the axially movable rotating blade cam 140. The second spring 160 thus applies a biasing force to the rotating blade cam 140 such that in its at rest, initial state, the second spring 160 is in an extended (non-compressed) state and this results in the rotating blade cam 140 being in a raised position relative to the outer housing 110 as shown in FIG. 15A. When the activation ball cam 120 moves downwardly within the outer housing 110 toward the distal end of the fishing tool 100 which directly results in the downward movement of the rotating blade cam 140 as well, the second spring 160 compresses and stores energy as shown in FIGS. 13 and 15B since the protrusions 145 move axially downward and compress the second spring 160.

The second spring 160 can have an annular shape to allow it fit within the second outer area 123.

It will be appreciated that in the raised states of both the activation ball cam 120 and the rotating blade cam 140, the first and second springs 150, 160 are both in the non-compressed states. Conversely, when both the activation ball cam 120 and the rotating blade cam 140 are in the lowered states, both of the first and second springs 150, 160 are in the compressed states.

Active Section 106

The active section 106 comprises the section that is designed to act either as an overshot or spear as described in more detail below.

The main component of the active section 106 is in the form of a modified spear that is shown in the figures and more particularly, the main component comprise slip blades 170 that function in both a spear operation and an overshot operation. In the illustrated embodiment, there are four slip blades 170 that are distinct from one another and are separately movable from one another. Each blade 170 has an arcuate shape and each can extend 90 degrees such that when the four blades 170 are combined, the four blades 170 define a complete circumference and define a circular shaped hollow body as shown.

Each blade 170 has a first end and an opposite second end along with an inner surface and an opposite outer surface. The blade 170 can be slightly tapered along its length in that in the direction from the first end to the second end, the blade 170 can have a slight inward taper. In addition, the thickness of the slip blade 170 varies along its length from the first end to the second end. More specifically, the slip blade 170 has a main body portion 172 that defines the maximum thickness of the blade. The main body portion 172 has an inner surface 173. The slide blade 170 further includes a top extension or top flange 174 that extends upwardly from the main body portion 172 and a bottom extension or bottom flange 176 that extends downwardly from the main body portion 172. The top extension 174 extends to and defines the first end, while the bottom extension 176 extends to and defines the second end. The thickness of each of the top extension 174 and the bottom extension 176 is less than the main body portion 172 and therefore, there is a first shoulder (e.g., right angle shoulder) formed between the top extension 174 and the main body portion 172 and a second shoulder (e.g., right angle shoulder) formed between the bottom extension 176 and the main body portion 172.

The slip blade 170 has an outer surface 178 that extends from the first end to the second end. Both the outer surface 178 and the inner surface 173 have profiled appearances. More specifically, both the outer surface 178 and the inner surface 173 can have a ribbed or serrated appearance defined by a plurality of ribs or serrations that are formed in a horizontal manner and are parallel to one another. The plurality or ribs or serrations provide a gripping surface along both the outer surface 178 of the slip blades 170 and the inner surface 173 of the slip blades 170. As shown in the figures, the outer surface of the top extension 174 can be free of the plurality of ribs or serrations and thus can be a smooth surface. The outer surface of the bottom extension 176 does include the plurality of ribs or serrations except the very distal end can be free of them. Since the plurality of ribs or serrations are located both along the inside of the slip blades 170 and the outside of the slip blades 170, they promote gripping in both a spear operation and an overshot operation. Thus, the slip blades 170 function both as spear (outer) slips and overshot (inner) slips.

In the retracted positions, the four slip blades 170 contact one another to define a single continuous circumferential structure. However, the inner diameter varies since the thickness of the slip blade 170 varies. In particular, when the four slip blades 170 are retracted, the inner diameter is less between the main body portions 172 and is greater between the top extensions 174 and is greater between the bottom extensions 176.

Figure 4:
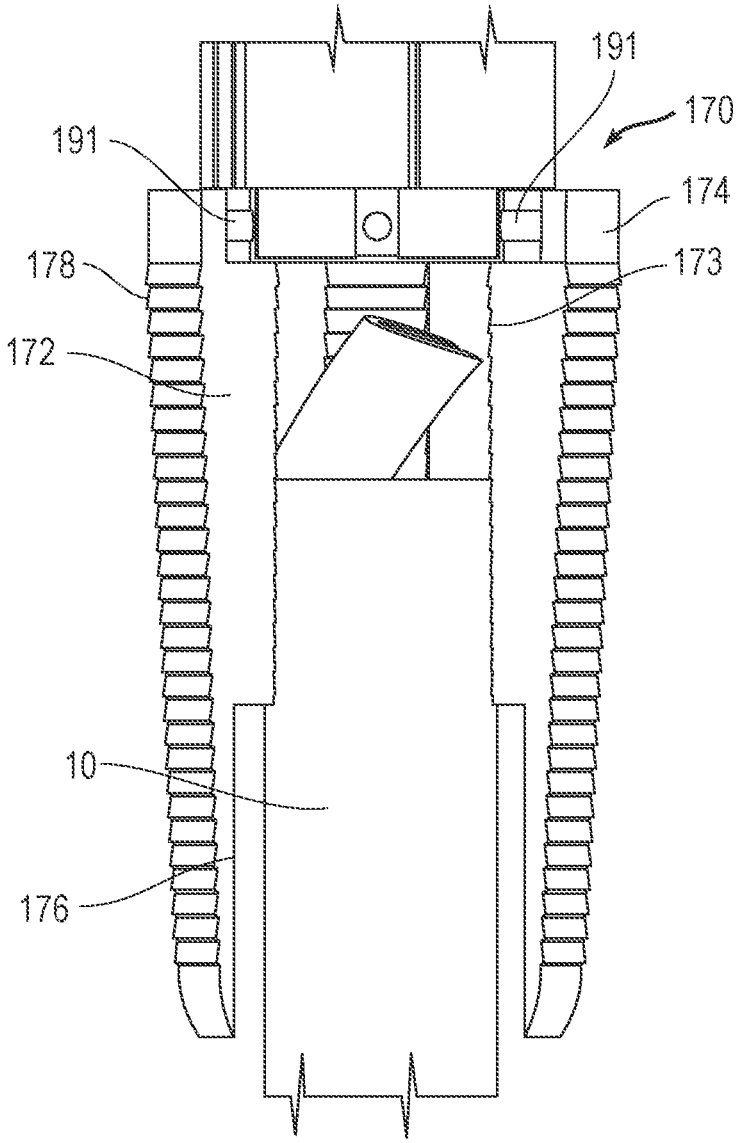
FIG. 4 is a partial side view showing the fishing tool in an overshot configuration and in relationship to a fish.

One of the key features of the slip blades 170 is that they move between an initial retracted state (FIG. 3) and an expanded state (FIG. 4). As shown, in the initial retracted state, the four slip blades 170 are in contact with one another with no gaps between the four slip blades 170, while in the expanded state, the four slip blades move radially outward and there are gaps between them. In the expanded state, the inner space within the slip blades 170 is naturally increased which allows for the slip blades 170 to function in the overshot mode.

Blade Expansion Guide 190

The fishing tool 100 also includes a blade expansion guide 190 that is in the form of a cylindrical hollow body that has an outer diameter that is the same as the outer diameter of the adjacent outer housing 110. The inner diameter of the blade expansion guide 190 is such that the distal end of the rotating blade cam 140 can be received within the hollow interior of the blade expansion guide 190. As shown, the blade expansion guide 190 abut the distal end of the outer housing 110 and is fixed relative thereto. The blade expansion guide 190 is thus a tubular structure and the distal end of the blade expansion guide 190 includes intersecting rails 192. The intersecting rails 192 can have a crosshair design in that there are two rails 192 that are oriented perpendicular to one another. Within each rail 192 there is a slot that extends longitudinally within the rail 192. The longitudinal slots are thus oriented perpendicular to one another.

As shown, the curved fingers 182 overlie the rails 192 and the slots 180 at least partially overlap the linear slots.

Radial Movement of the Slip Blades 170

As mentioned, each slip blade 170 is configured to move radially between the fully retracted position and the fully extended position. Each slid blade 170 includes a connector rod 191 that is attached to the inner surface of the top extension 174 (FIG. 4). The connector rod 191 can be a circular rod.

The connector rod 191 can be at a 90 degree angle relative to the top extension 174. Each connector rod 191 extends within or along one rail 192 of the blade expansion guide 190. The connector rod 191 has an upward standing pin 193. The pin 193 can be formed at a 90 degree angle relative to the rail 192.

The pin 193 passes through the longitudinal slot in rail 192 and passes through the slot 180 formed in the corresponding curved finger 182. The pins 193 thus move longitudinally along the slots formed in the rails 192 which is guided by the intersection of the elements 192, 180 as the rotating cam rotates.

As a result, the slip blades 170 are operatively connected to the rotating blade cam 140 and thus, as described herein, rotation of the rotating blade cam 140 is transferred to movement of the pins 193 within the radial slots 180 and this riding of the pins 193 within the radial slots 180 push the slip blades 170 radially outward, thereby expanding its size.

Thus, it will be appreciated that each slip blade 170 is coupled to one guide rail (rail 192) to direct its extension direction.

System Deployment Procedure

The complete operation of the present tool is now described. The combined overshot/spear tool described herein is achieved by modifying (converting) a spear to accommodate an internal hollow section equipped with overshot slips (slid blades 170).

Figure 10:
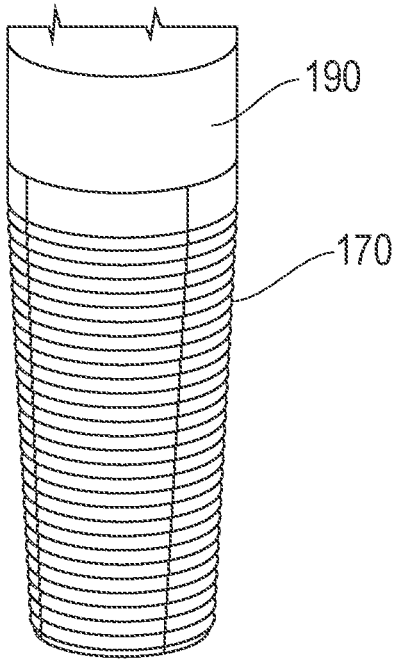
FIG. 10 is a view of an expandable slip blade assembly in an initial fully retracted state.
Figure 11:
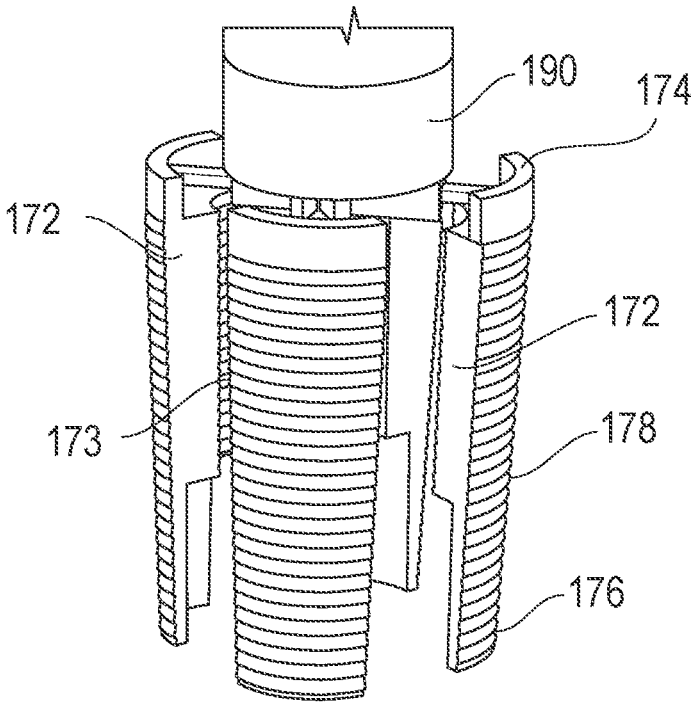
FIG. 11 is a view of the expandable slip blade assembly in a fully expanded (extended) state.

The initial at rest position is one in which the slip blades 170 are in the fully retracted positions as shown in FIGS. 10 and 15A. The fishing tool 100 is lowered down the wellbore and an attempt is made to engage the top of the fish that is located in the wellbore. In this action, the tool 100 is being used as a spear that tries to engage the fish. If successful, the fish 10 is captured as shown in FIG. 3. This is the first operating mode of the tool 100 in which it is used as a spear.

If engagement of the fish 10 is not successful, then the fishing tool 100 is converted from the spear operating mode to the overshot operating mode. First, as shown in FIG. 15A, a ball 20 is dropped into the hollow center of the activation ball cam 120, thereby blocking the fluid path therein. The ball 20 seats within the ball seat 130.

Such blocking allows pressure to build up (the drilling fluid is pressurized) within the tool 100. In this initial position, the activation ball cam 120 and the rotating blade cam 140 abut one another. The pressure buildup shifts the ball activation cam 120 downwards within the outer housing 110. The activation ball cam 120 provides a downward force against the second protrusions 149 resulting the rotating blade cam 140 also moving downwardly within the outer housing 110. As the rotating blade cam 140 moves downward, the first protrusions 145 ride along the inner profile 111 of the outer housing 110 causes rotation of the rotating blade cam 140 relative to the outer housing 110 as shown in FIGS. 13 and 15B.

In other words, the activation ball cam 120 shifts downward and drives the inner feature (second protrusions 149) on the rotating blade cam 140 resulting in the second protrusions 149 being slightly shifted due to the activation ball cam's inner tooth profile and will not be able to return to its starting position upon release due to the outer feature's (first protrusions 145) constraint on the inner profile 111 of the outer housing 110.

As both the activation ball cam 120 and the rotating blade cam 140 move downward within the outer housing 110, both the active ball cam spring 150 and the rotating blade cam spring 160 compress and store energy.

Figure 14:
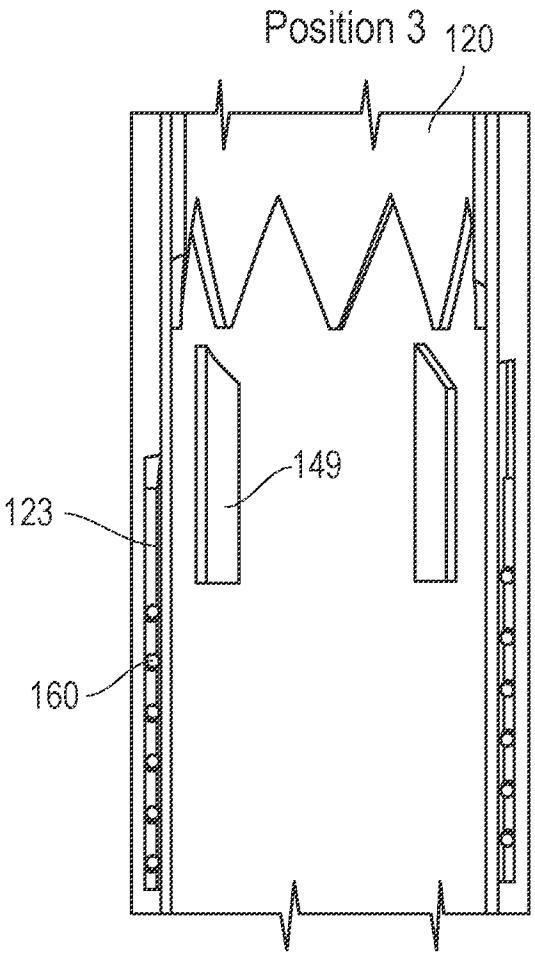
FIG. 14 is a cross-sectional view of the actuation system in a third position.

Pressure within the tool 100 continues to buildup and once the inner pressure reaches a predetermined threshold pressure value, the ball 20 is forced through the ball seat 130, thereby opening up the fluid pathway. Such opening of the fluid pathway relieves the built up inner pressure within the tool 100. Once this pressure is released, the active ball cam spring 150 and rotating blade cam spring 160 are no longer acted upon and release their stored energy. The return force of the active ball cam spring 150 and the rotating blade cam spring 160 returns both the activation ball cam 120 and the rotating blade cam 140 to their uncompressed position. In other words, the return force of active ball cam spring 150 and the rotating blade cam spring 160 drives the activation ball cam 120 and the rotating blade cam 140 upward within outer housing 110. The second protrusions 149 engage and lock within the inner profile 111 in a new locked position as shown in FIGS. 14 and 15C. In this newly locked position, the slip blades 170 remain in the fully extended (expanded) positions as shown in FIG. 15C.

This movement (cycle) of activation ball cam 120 and the rotating blade cam 140 also causes movement of the slip blades 170 between the fully retracted positions and the fully extended positions. In particular, as described herein, when the rotating blade cam 140 rotates, the slot-pin mechanism rotates for the slip blades 170. As described herein, as the rotating blade cam 140 rotates, the radial slots 180 are part of the rotating blade cam 140 and thus, they also rotate causing the pins 193 to ride along the radial slots 180 to push the slip blades 170 radially outward, thereby expanding its size. In other words, since the pins 193 are part of the slip blades 170, the riding action of the pins 173 in the radial slots 180 causes the radial movement of the slip blades 170. The riding of the pins 173 in a first direction (radial outward) results in the radial outward expansion of the slip blades to the fully extended positions. Conversely, when the pins 173 ride in a second direction (radial inward), the slip blades 170 move radially inward to the fully retracted positions.

As mentioned, in the event that the spear operation does not successfully engage the fish 10, the user can then convert the fishing tool 100 to the overshot configuration by performing the steps described above which results in the radial expansion of the slip blades 170. The conversion to the overshot mode results in an increased hollow interior being formed within the slip blades 170, thereby allowing the fish 10 to be captured within and between the radially expanded slip blades 170. Once the fish 20 is captured, the fishing tool 100 can be removed from the wellbore with the fish 10 intact. If the fish is not snagged initially, the above steps are repeated until the fish is snagged.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A convertible fishing tool for removing an object from a wellbore comprising:

an elongated hollow main housing;

a plurality of slip blades that are disposed distal to the main housing and move radially between fully retracted positions and fully extended positions, wherein the plurality of slip blades define a distal end of the fishing tool and are adjacent one another in a circumferential direction about a center axis of the fishing tool, wherein in the fully retracted positions, the fishing tool is in spear configuration and in the fully extended positions, the fishing tool is in an overshot configuration; and an actuation system configured to move the plurality of slip blades in a radial direction between the fully retracted positions and the fully extended positions.

2. The fishing tool of claim 1, wherein the main housing includes a first internal stop and a second internal stop formed along an inner bore of the main housing with an inner profile being formed along the inner bore between the first internal stop and the second internal stop.

3. The fishing tool of claim 2, wherein each of the first internal stop and the second internal stop comprises an annular shaped flange that protrudes inwardly.

4. The fishing tool of claim 2, wherein the inner profile comprises a zig-zag shaped exposed edge formed along the inner bore.

5. The fishing tool of claim 2, wherein the actuation system comprises an activation ball cam and a rotating blade cam located in series with the rotating blade cam being located distal to the activation ball cam, the rotating blade cam being operatively coupled to plurality of slip blades, the actuation system further including a first spring disposed between the first internal stop and the activation ball cam and a second spring disposed between the second internal stop and rotating blade cam, wherein when the slip blades are in the fully retracted positions, the first and second springs are in extended states and are not storing energy and wherein when the slip blades are in the fully extended positions, the first and second springs are compressed and store energy.

6. The fishing tool of claim 1, wherein each slip blade has a tapered shape and is defined by: a main body that has a first thickness, a top flange extending upwardly from a top of the main body, and a bottom flange extending downwardly from a bottom of the main body, wherein a thickness of each of the top flange and the bottom flange is less than the first thickness, wherein an inner surface of the slip blade comprises an inner profiled surface and an outer surface of the slip blade comprises an outer profiled surface.

7. The fishing tool of claim 6, wherein each of the inner profiled surface and the outer profiled surface comprises a serrated surface.

8. A convertible fishing tool for removing an object from a wellbore comprising:

an elongated hollow main housing;

a plurality of slip blades that are disposed distal to the main housing and move radially between fully retracted positions and fully extended positions, wherein in the fully retracted positions, the fishing tool is in spear configuration and in the fully extended positions, the fishing tool is in an overshot configuration; and an actuation system configured to move the plurality of slip blades in a radial direction between the fully retracted positions and the fully extended positions;

wherein the actuation system comprises an activation ball cam and a rotating blade cam located in series with the rotating blade cam being located distal to the activation ball cam, the rotating blade cam being operatively coupled to the plurality of slip blades.

9. The fishing tool of claim 8, wherein the activation ball cam is hollow and includes a center bore formed therethrough with a ball seat being disposed within the center bore.

10. The fishing tool of claim 9, wherein the ball seat is part of a ball seat system that allows for a buildup of hydraulic pressure within the fishing tool which in turn activates the actuation system when the hydraulic pressure increases.

11. The fishing tool of claim 10, wherein the ball seat system includes a ball that is configured to seat against the ball seat to block fluid flow through the activation ball cam and cause buildup of the hydraulic pressure, wherein when the hydraulic pressure exceeds a predetermined value, the ball and ball seat are configured to permit the ball to pass through the ball seat, thereby releasing the built up hydraulic pressure.

12. The fishing tool of claim 8, wherein the rotating blade cam includes a plurality of inner protrusions formed along a center bore formed through the rotating blade cam and a plurality of outer protrusions formed along an outer surface of the rotating blade cam.

13. The fishing tool of claim 12, wherein the activation ball cam engages the plurality of inner protrusions and the plurality of outer protrusions engage an inner profile formed along an inner surface of the outer housing, wherein the inner profile is formed so that axial movement of the activation ball cam is translated into axial movement and simultaneous rotation of the rotating blade cam within the outer housing.

14. The fishing tool of claim 12, wherein the plurality of inner protrusions are arranged circumferentially and the plurality of outer protrusions are arranged circumferentially.

15. The fishing tool of claim 8, wherein the rotating blade cam has a plurality of curved blade guides formed at a distal end thereof, each curved blade guide having a curved slot formed therein.

16. The fishing tool of claim 15, wherein the curved slot has opposing closed ends and one slip blade of the plurality of slip blades is operatively coupled to one curved slot of the plurality of curved slots such that rotation of the rotating blade cam translates motion to the plurality of slip blades.

17. The fishing tool of claim 16, wherein each slip blade has a pin that is captured within one curved slot, thereby coupling the one slip blade to the one curved slot of one curved blade guide of the rotating blade cam.

18. The fishing tool of claim 17, wherein in the fully retracted positions of the plurality of slip blades, the pins of the plurality of slip blades are located closer to a center of the rotating blade cam compared to when the plurality of slip blades are in the fully extended positions.

19. The fishing tool of claim 17, wherein the curved slots are shaped so that rotation of the rotating blade cam is translated into radial movement of the plurality of slip blades between the fully retracted positions and the fully extended positions.

20. The fishing tool of claim 8, wherein the actuation system is configured to operate in a cycle defined by: a first position in which the activation ball cam and the rotating blade cam are in raised positions and an outer profile of the rotating blade cam engages an inner profile of the outer housing at a first location; a second position in which the activation ball cam and the rotating blade cam are in lowered, depressed positions and the outer profile of the rotating blade cam engages the inner profile of the outer housing at a second location; and a third position in which the activation ball cam and the rotating blade cam are in raised positions and an outer profile of the rotating blade cam engages an inner profile of the outer housing at a third location; wherein the first, second and third locations are circumferentially spaced apart.

21. A method of fishing for an object in a wellbore comprising the steps of:

inserting a fishing tool inside the wellbore in a first state that comprises a spear configuration of the fishing tool, wherein the fishing tool includes an elongated hollow main housing and a plurality of slip blades that are disposed distal to the main housing and move radially between fully retracted positions and fully extended positions, wherein the spear configuration, the plurality of the slip blades are in the fully retracted positions;

converting the fishing tool from the first state to a second state that comprises an overshot configuration of the fishing tool if the object is not able to be retrieved with the fishing tool in the spear configuration, wherein the overshot configuration, the plurality of slip blades are in the fully extended positions, wherein the step of converting the fishing tool comprises the step of:

increasing fluid pressure within the fishing tool to cause axial movement in a first direction of an actuation system that is contained within the outer housing and is operatively coupled to the plurality of slip blades, whereby as the actuation system moves axially, the actuation system also rotates, thereby causing the plurality of slip blades to move radially outward from the fully retracted positions to the fully extended positions.

22. The method of claim 21, wherein the step of increasing fluid pressure comprises the step of dropping a ball into the actuation system causing the ball to seat against a ball seat, thereby blocking an internal fluid path within the actuation system causing the actuation system to be driven in a first direction to a lowered position and whereupon when the increased fluid pressure exceeds a predetermined value, the ball passes through the ball seat and the fluid pressure drops resulting in the actuation system moving axially in an opposite second direction to an initial raised position of the actuation system.

23. The method of claim 21, wherein the actuation system includes an activation ball cam and a rotating blade cam located in series with the rotating blade cam being located distal to the activation ball cam, the rotating blade cam being operatively coupled to the plurality of slip blades and the step of increasing the fluid pressure results in the activation ball cam axially driving the rotating blade cam and rotation of the rotating blade cam is caused by an outer profile of the rotating blade cam riding along an inner profile formed within the outer housing.

24. The method of claim 23, wherein the rotating blade cam has a plurality of curved blade guides formed at a distal end thereof, each curved blade guide having a curved slot formed therein and wherein each slip blade has a pin that is captured within one curved slot, thereby coupling the one slip blade to the one curved slot of one curved blade guide of the rotating blade cam and movement of the pin within the curved slot due to the rotation of the rotating blade cam is translated into movement of the plurality of slip blades between the fully retracted positions and the fully extended positions.

25. The method of claim 21, further including the step of releasing the increased fluid pressure to cause axial movement in an opposite second direction of the actuation system.

* * * * *